US010786748B2

(12) United States Patent
Deng et al.

(10) Patent No.: US 10,786,748 B2
(45) Date of Patent: Sep. 29, 2020

(54) MULTI-DIMENSIONAL BUILDING SET OF BUILDING BLOCK TOYS CAPABLE OF BEING BUILT FREELY ON FRONT AND BACK SIDES

(71) Applicant: Shanghai Putao Technology Co., Ltd., Shanghai (CN)

(72) Inventors: Shanjun Deng, Shanghai (CN); Ye Xiao, Shanghai (CN)

(73) Assignee: SHANGHAI PUTAO TECHNOLOGY CO., LTD., Shanghai (CN)

( * ) Notice: Subject to any disclaimer, the term of this patent is extended or adjusted under 35 U.S.C. 154(b) by 0 days.

(21) Appl. No.: 16/604,456

(22) PCT Filed: Sep. 12, 2017

(86) PCT No.: PCT/CN2017/101443
§ 371 (c)(1),
(2) Date: Oct. 10, 2019

(87) PCT Pub. No.: WO2018/188263
PCT Pub. Date: Oct. 18, 2018

(65) Prior Publication Data

US 2020/0147509 A1 May 14, 2020

(30) Foreign Application Priority Data

Apr. 10, 2017 (CN) ..... 2017 1 0227672

(51) Int. Cl.
*A63H 33/08* (2006.01)
*E04B 2/00* (2006.01)

(52) U.S. Cl.
CPC ..... *A63H 33/086* (2013.01)

(58) Field of Classification Search
CPC ..... A63H 33/00; A63H 33/06; A63H 33/08; A63H 33/084; A63H 33/086; A63H 33/088; E04B 2/00; E04B 2/18; E04B 2002/0228
(Continued)

(56) References Cited

U.S. PATENT DOCUMENTS 5,848,927 A * 12/1998 Frederiksen ..... A63H 33/086 446/128
6,554,676 B1 * 4/2003 Bach ..... A63H 33/086 446/116
(Continued)

FOREIGN PATENT DOCUMENTS

CN 202637989 U 1/2013
CN 104623908 A 5/2015
(Continued)

OTHER PUBLICATIONS

International Search Report of PCT/CN2017/101443.
Written Opinion of PCT/CN2017/101443.

*Primary Examiner* — Kien T Nguyen
(74) *Attorney, Agent, or Firm* — Dragon Sun Law Firm, PC; Jinggao Li, Esq.

(57) ABSTRACT

The present disclosure relates to the technical field of building block toys and provides a multi-dimensional building set of building block toys, including: a first module, a front side of the first module has a single first coupling short post or a single column, two columns or multiple columns of first coupling short posts, and a back side of the first module has a concave surface, there are multiple columns of convex second coupling short posts in the concave surface and there are a plurality of ribs on sidewalls of the concave surface; the second coupling short posts are distributed as follows: column: the columns are uniformly distributed in the same columns as the first coupling short posts on the
(Continued)

front side and located in a middle position between two adjacent columns; line: in the same columns as the first coupling short posts on the front side.

10 Claims, 11 Drawing Sheets

(58) Field of Classification Search
USPC ..... 472/85, 105–108, 117–118, 120–126, 472/128; 52/561, 592.6, 603–605, 612
See application file for complete search history.

(56) References Cited

U.S. PATENT DOCUMENTS 6,645,033 B1 * 11/2003 Thomsen ..... A63H 33/086 446/120
8,771,032 B2 * 7/2014 Chang ..... A63H 33/086 446/124
8,905,812 B2 * 12/2014 Pai-Chen ..... A63H 33/107 446/122
9,345,981 B1 5/2016 Lama

FOREIGN PATENT DOCUMENTS

CN 106955495 A 7/2017
DE 1837030 U 8/1961

* cited by examiner

MULTI-DIMENSIONAL BUILDING SET OF BUILDING BLOCK TOYS CAPABLE OF BEING BUILT FREELY ON FRONT AND BACK SIDES

CROSS-REFERENCE TO RELATED APPLICATIONS

This application is a national stage application of PCT Application No. PCT/CN2017/101443. This Application claims priority from PCT Application No. PCT/CN2017/101443, filed Sep. 12, 2017, CN Application No. CN 201710227672X filed Apr. 10, 2017, the contents of which are incorporated herein in the entirety by reference.

Some references, which may include patents, patent applications, and various publications, are cited and discussed in the description of the present disclosure. The citation and/or discussion of such references is provided merely to clarify the description of the present disclosure and is not an admission that any such reference is "prior art" to the present disclosure described herein. All references cited and discussed in this specification are incorporated herein by reference in their entireties and to the same extent as if each reference was individually incorporated by reference.

TECHNICAL FIELD

The present invention relates to a building set of building block toys, and in particular to a multi-dimensional building set of building block toys capable of being built freely.

BACKGROUND

A building block toy is a toy that builds together multiple pieces of blocks to realize the builder's creativity. There are usually a plurality of unit modules of different specifications and designs to build a variety of toys. For example, FIG. 1 shows a front side of A module which has a plurality of convex coupling short posts (h). FIG. 2 shows a back side of the A module which has a concave surface, there are one or more convex coupling short posts (i) in the concave surface and there are a plurality of ribs on the sidewalls of the concave surface. FIG. 3 shows a front side of B module which has a plurality of convex coupling short posts (j). FIG. 4 shows a back side of the B module which has a concave surface, there are one or more convex coupling short posts (k) in the concave surface.

There are three ways to build blocks in the prior art:

The building of the A module itself: the building is performed by the frictional force formed by coupling the coupling short posts h on the front side of the A module with the coupling short posts i on the back side and the ribs on the sidewalls of the back side.

The building of the front side of the A module and the back side of the B module: the building is performed by the frictional force formed by coupling the coupling short posts k and the coupling short posts h.

The building of the back side of the A module and the front side of the B module: the building is performed by the frictional force formed by coupling the coupling short posts j and the ribs on the sidewalls of the back side of the A module. This way has a number of limitations, for example, as shown in FIGS. 5 and 6, the front side of the B module does not match the back side of the A module in size and cannot be well coupled.

As mentioned above, the existing building set of building block toys can only provide three building ways, and cannot provide the building way of the back side of the A module and the back side of the B module; there are a number of limitations in the building way of the back side of the A module and the front side of the B module constrainedly provided in the prior are. The dimensions and degrees of freedom of building by the existing building set of building block toys are greatly limited by these shortcomings, and the idea of the builder cannot be realized freely.

The object of the present invention is to provide a multi-dimensional building set of building block toys capable of being built freely on front and back sides, which ensures the degrees of freedom in the multi-dimensional building of the blocks.

Therefore, a heretofore unaddressed need exists in the art to address the aforementioned deficiencies and inadequacies.

SUMMARY

The invention provides a multi-dimensional building set of building block toys capable of being built freely on front and back sides, and the technical solutions are as follows:

A multi-dimensional building set of building block toys capable of being built freely on front and back sides, comprising: a first module, wherein, one solution for the first module is:

a front side of the first module has a single first coupling short post or a single column, two columns or multiple columns of first coupling short posts (r), and a back side of the first module has a concave surface, there are multiple columns of convex second coupling short posts (t) in the concave surface and there are a plurality of ribs on sidewalls of the concave surface; the second coupling short posts (t) are distributed as follows:

column: the columns are uniformly distributed in the same columns as the first coupling short posts (r) on the front side and located in a middle position between two adjacent columns;

line: in the same columns as the first coupling short posts (r) on the front side, each of the second coupling short posts (t) is arranged alternately with the first coupling short post (r) and located in a middle position between two first coupling short posts (r); therefore, in such a column, the number of the second coupling short posts (t) is one less than the number of the first coupling short posts (r);

in a column located in a middle position between two adjacent columns of the first coupling short posts (r), each of the second coupling short posts (t) is located in the middle position between two first coupling short posts (r) of the same line; therefore, in such a column, the number of the second coupling short posts (t) is the same as the number of the first coupling short posts (r);

or:

another solution for the first module is:

A front side of the first module has a single first coupling short post (r), a back side of the first module has a concave surface, and there are a plurality of ribs on sidewalls of the concave surface. In a preferred embodiment, the back side of the first module does not have a coupling short post, for example, the second coupling short post (t).

The above-mentioned multi-dimensional building set of building block toys capable of being built freely on front and back sides further comprises a second module, wherein a front side of the second module has a single first coupling short post or a single column, two columns or multiple columns of third coupling short posts (s), the third coupling short post (s) is a cylinder penetrating through the second module; the number of the third coupling short posts (s) may be 1, 2, 3 or any number.

The above-mentioned multi-dimensional building set of building block toys capable of being built freely on front and back sides, wherein a back side of the second module has a concave surface, there are convex fourth coupling short posts (u) in the concave surface and there are a plurality of ribs exactly facing the fourth coupling short posts (u) on the sidewalls of the concave surface; the fourth coupling short posts (u) on the back side of the second module are distributed as follows:

column: the columns are located in a middle position between two adjacent columns of the third coupling short posts (s) on the front side;

line: each of the fourth coupling short posts (u) is located in a middle position between two third coupling short posts (s); therefore, the number of the fourth coupling short posts (u) is one less than the number of the third coupling short posts (s).

The above-mentioned multi-dimensional building set of building block toys capable of being built freely on front and back sides, wherein the diameters of the second coupling short post (s), the third coupling short post (t) and the fourth coupling short post (u) are the same; the relationship of the diameters of the second coupling short post (s), the third coupling short post (t) and the fourth coupling short post (u) and the width of the second modules is:

the diameter of the coupled post is $d(s)=X/2-g*2-h*2$ wherein, X is the width of the second module; g is the wall thickness of the sidewall of the second module; and h is the thickness of the rib on the sidewall of the second module.

The above-mentioned multi-dimensional building set of building block toys capable of being built freely on front and back sides, wherein the width of the second module is 20 mm, the wall thickness g of the sidewall of the second module is 1.2 mm, the thickness h of the rib on the sidewall of the second module is 0.25 mm; the diameters of the second coupling short post (s), the third coupling short post (t) and the fourth coupling short post (u) are $d(s)=d(t)=d(u)=7.1$ mm.

The above-mentioned multi-dimensional building set of building block toys capable of being built freely on front and back sides, wherein the diameter d(r) of the first coupling short post (r) on the first module is equal to the distance f between two adjacent second coupling short posts (t) subtracting d(t); the first coupling short post (r) is a cylinder penetrating through the first module.

The above-mentioned multi-dimensional building set of building block toys capable of being built freely on front and back sides, wherein the diameter d(r) of the first coupling short post (r) is equal to the distance f between two adjacent second coupling short posts (t) subtracting $d(t)=20-7.1=12.9$ mm.

The above-mentioned multi-dimensional building set of building block toys capable of being built freely on front and back sides, wherein the diameters of the first coupling short post (r), the second coupling short post (s), the three coupling short post (t) and the fourth coupling short post (u) is 0.01 mm to 0.10 mm larger than the calculated value to maintain the frictional force of the coupling.

The above-mentioned multi-dimensional building set of building block toys capable of being built freely on front and back sides further comprising an element, a post head of the element having an interference fit with the cylindrical coupling short post.

The above-mentioned multi-dimensional building set of building block toys capable of being built freely on front and back sides, wherein all module edges are rounded; the coupling short posts of the modules and the rounded corners of the edges have the same center; a plurality of unit modules are assembled to form a uniform fitting curved surface.

Beneficial Effects:

Compared with the prior art, the advantages and positive effects of the present invention are as follows:

In addition to the building of the C module itself and the free building of conventional building blocks, the present invention provides a more free building capability and building feeling in the following various building ways:

1. Coupling of the front side of the C module and the back side of the D module: the frictional force is produced by the coupling of the coupling short post r, the coupling short post u and the sidewall of the D module. Since the deformation force of the sidewall is relatively small, this way can better control the frictional force of the coupling and the feeling of experience than the prior art.

2. Coupling of the back side of the C module and the front side of the D module: the frictional force is produced by both of the sidewall of the C module and the coupling short post t and the coupling short post s on the front side of the D module. The design of the present invention can achieve coupling anywhere.

3. Coupling of the back side of the C module and the back side of the D module: since the diameters of the coupling short posts s, t, and u of the present invention are the same, the back side of the C module and the back side of the D module can be arbitrarily coupled and built.

4. Coupling of the front side of the C module and the front side of the D module: the diameters of the coupling short posts s and u on the front and back sides of the D module are the same, therefore, in addition to the coupling of the back side of the D module and the front side of the C module, the front side of the D module and the front side of the C module can be arbitrarily coupled and built, especially when the C module is a very large flat element (such as 50 CM*50 CM), this feature will be more prominent. (FIG. 17, FIG. 18)

5. Coupling of the back side of the C module and the front side of the L module: the L module is an implementation of the C module and the front side thereof has only one coupling short post, and the diameter of the coupling short post is the same as r, therefore, the L module can be coupled to any position of the back side of the C module, which can provides a lot of variation and design space. (FIG. 19)

6. The coupling short post on the front side of the C/D module is not limited to eight. The illustration in this document is only schematic, and there can be 1, 2, 3 . . . 5 . . . 10 . . . 20 . . . 50 . . . and countless coupling short posts, which can provide more unimaginable building fun. Through the design that the module edges are rounded; the coupling short posts of the modules and the rounded corners of the edges have the same center; a plurality of unit modules are assembled to form a uniform fitting curved surface, the hand feeling will be more comfortable, the appearance will be more uniform, free and safe, and it is easier to build toys of different series and different designs and to realize various ideas of the builders.

BRIEF DESCRIPTION OF THE DRAWINGS

The accompanying drawings illustrate one or more embodiments of the present invention and, together with the written description, serve to explain the principles of the invention. Wherever possible, the same reference numbers are used throughout the drawings to refer to the same or like elements of an embodiment.

The present invention will be described in detail below with reference to the accompanying drawings and specific embodiments.

DETAILED DESCRIPTION

The invention provides a multi-dimensional building set of building block toys capable of being built freely on front and back sides, which improves the degrees of freedom in the building of the blocks.

In order to facilitate the understanding of the measures, creative features, objectives and effects achieved by the techniques of the present invention, the present invention will be further described below in conjunction with the specific drawings.

Figure 1:
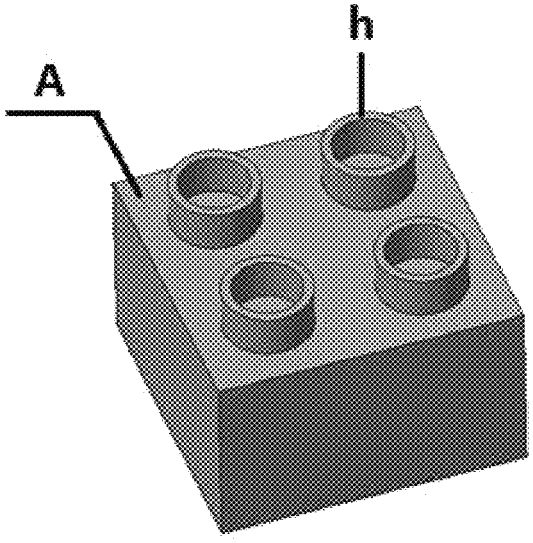
FIG. 1 is a schematic view showing a front side of A module of a conventional building set of building block toys.
Figure 2:
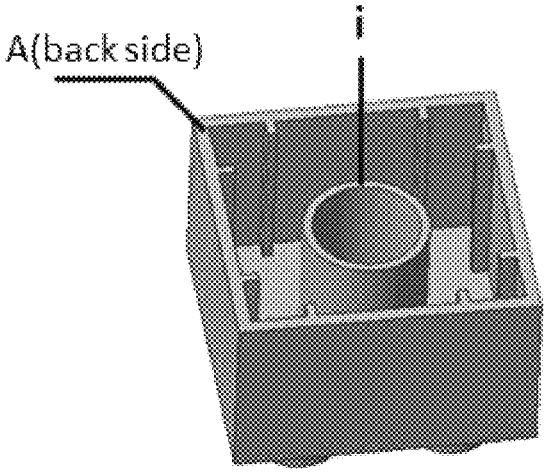
FIG. 2 is a schematic view showing a back side of the A module of the conventional building set of building block toys.
Figure 3:
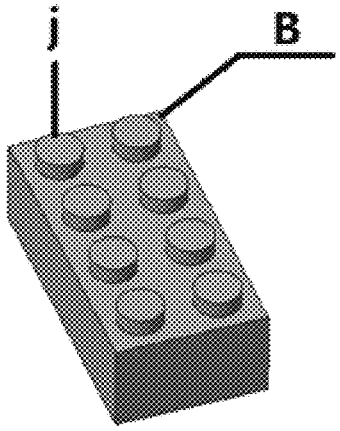
FIG. 3 is a schematic view showing a front side of B module of the conventional building set of building block toys.
Figure 4:
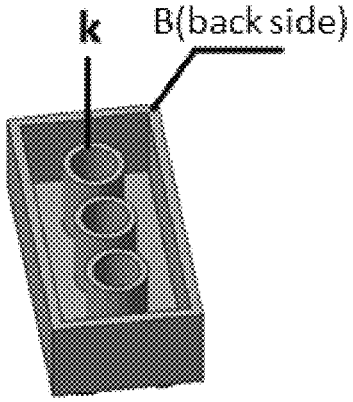
FIG. 4 is a schematic view showing a back side of the B module of the conventional building set of building block toys.
Figure 5:
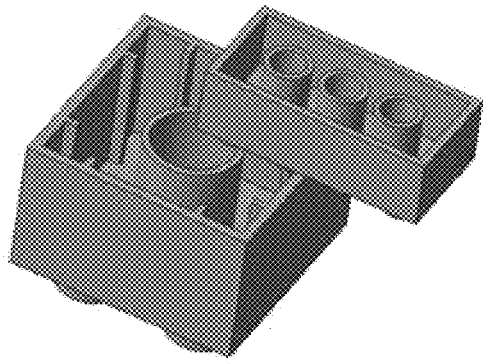
FIG. 5 is a schematic view showing the building way of the back side of the A module and the front side of the B module of the conventional building set of building block toys.
Figure 6:
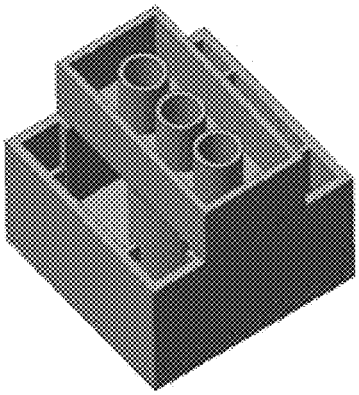
FIG. 6 is a schematic view showing the building way of the back side of the A module and the front side of the B module of the conventional building set of building block toys.
Figure 7:
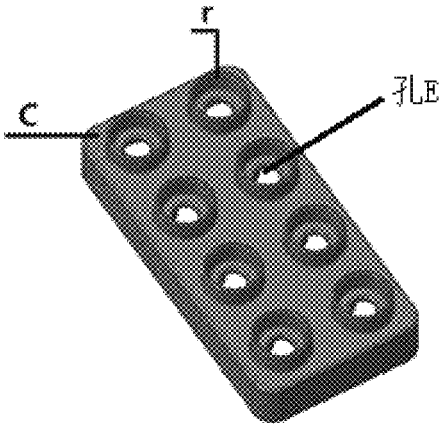
FIG. 7 is a schematic view showing a front side of C module (first module) according to the present invention.

FIG. 7 is a schematic view showing a front side of C module (first module) according to the present invention, which has multiple columns of coupling short posts r, the coupling short post r is a cylinder penetrating through the C module.

Figure 8:
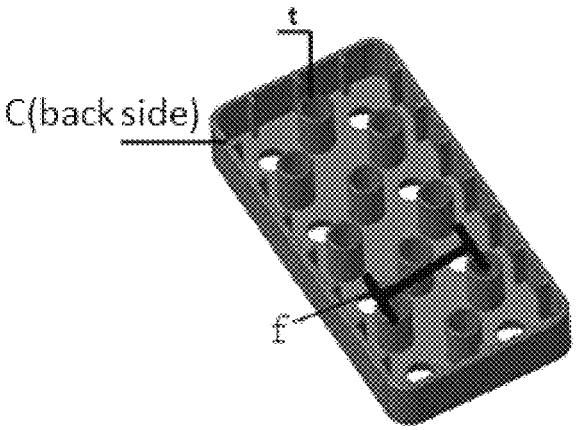
FIG. 8 is a schematic view showing a back side of the C module according to the present invention.

FIG. 8 is a schematic view showing a back side of the C module according to the present invention, which has a concave surface, there are multiple columns of convex coupling short posts (t) in the concave surface and there are a plurality of ribs on sidewalls of the concave surface. The coupling short posts (t) on the back side of the C module are distributed as follows: column: the columns are uniformly distributed in the same columns as the coupling short posts (r) on the front side and located in a middle position between two adjacent columns; line: in the same columns as the coupling short posts (r) on the front side, each of the coupling short posts (t) is arranged alternately with the coupling short post (r) and located in a middle position between two coupling short posts (r). Therefore, in such a column, the number of the coupling short posts (t) is one less than the number of the coupling short posts (r). In a column located in a middle position between two adjacent columns of the coupling short posts (r), each of the coupling short posts (t) is located in the middle position between two coupling short posts (r) of the same line. Therefore, in such a column, the number of the coupling short posts (t) is the same as the number of the coupling short posts (r).

Figure 9:
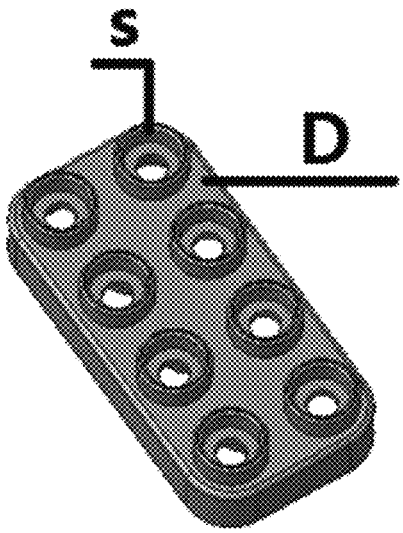
FIG. 9 is a schematic view showing a front side of D module (second module) according to the present invention.

FIG. 9 is a schematic view showing a front side of D module (second module) according to the present invention, which has multiple columns of coupling short posts s, the coupling short post s is a cylinder penetrating through the D module. The number of the coupling short posts (s) is the same as the number of the coupling short posts (r) of the C module.

Figure 10:
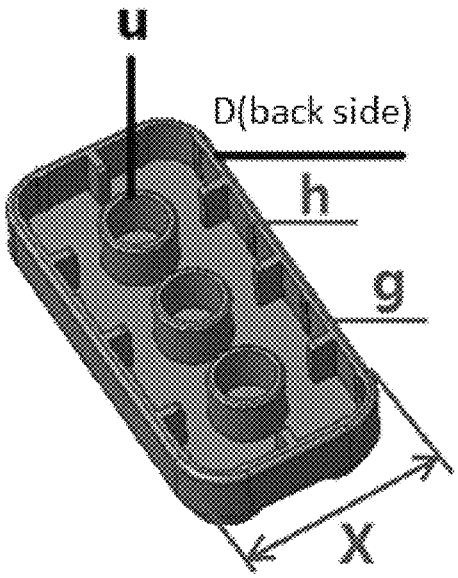
FIG. 10 is a schematic view showing a back side of the D module according to the present invention.

FIG. 10 is a schematic view showing a back side of the D module according to the present invention, which has a concave surface, there are a column of coupling short posts (u) in the concave surface and there are a plurality of ribs exactly facing the coupling short posts (u) on four sidewalls of the concave surface. The coupling short posts (u) on the back side of the D module are distributed as follows: column: the columns are located in a middle position between two adjacent columns of the coupling short posts (s) on the front side; line: each of the coupling short posts (u) is located in a middle position between two coupling short posts (s). Therefore, the number of the fourth coupling short posts (u) is one less than the number of the third coupling short posts (s) in each column.

The invention is designed such that the coupling short posts r, s, t, u on the C module and the D module have the following relationship:

The diameters of the coupling short posts s, t, u are the same.

The relationship of the diameters of the coupling short posts s, t, u and the width of the D modules is as follows:

the diameter of the coupled post is $d(s)=X/2-g*2-h*2$, wherein, X is the width of the second module; g is the wall thickness of the sidewall of the second module; and h is the thickness of the rib on the sidewall of the second module, for example, the width of the D module is 20 mm, the wall thickness g of the sidewall of the D module is 1.2 mm, the thickness h of the rib on the sidewall is 0.25 mm, then d(s)=d(t)=d(u)=X/2−g*2−h*2=20/2−1.2*2−0.25*2=7.1 mm.

Other size embodiments are not described again.

The diameter of the coupling short post r on the C module is obtained from the diameter of the coupling short post t on the back side, and the method is as follows:

The diameter d(r) of the coupling short post (r) on the C module is equal to the distance (f) between two adjacent coupling short posts (t) subtracting d(t).

In the example with above specific size, the d(r) is:

d(r)=distance (f) between two coupling short posts (t)−d (t)=X−d(t)=12.9 mm.

In the actual design process, the actual diameters d(r), d(s, t, u) will be slightly larger than 12.9 mm and 7.1 mm to produce a frictional force, for example, 0.01 mm~0.10 mm larger.

Figure 11:
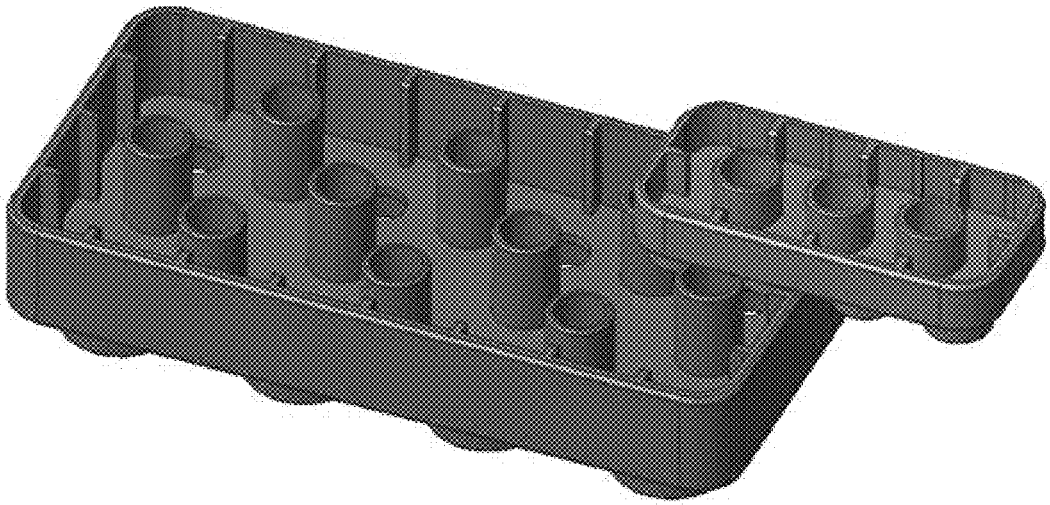
FIG. 11 is a schematic view showing the coupling of the back side of the C module and the front side of the D module according to the present invention.
Figure 12:
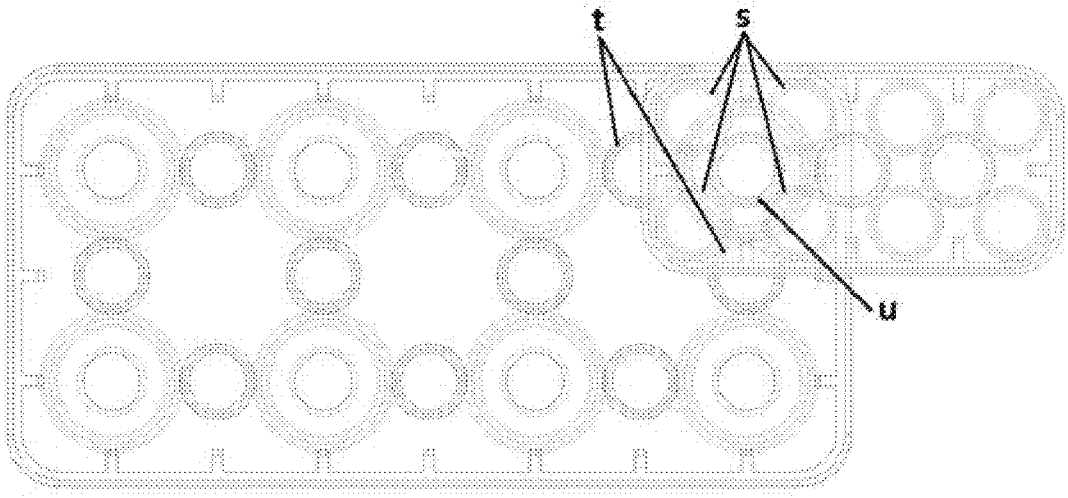
FIG. 12 is a principle diagram of the coupling relationship of FIG. 11 according to the present invention.

Such a wise design brings multi-dimensional freely building properties to the present invention. FIG. 11 is a schematic view showing the coupling of the back side of the C module and the front side of the D module. FIG. 12 is a principle diagram of the coupling relationship of FIG. 11. It can be seen that the coupling is successful because of the design of the coupling short posts r, s, t, u on the C module and the D module.

Figure 13:
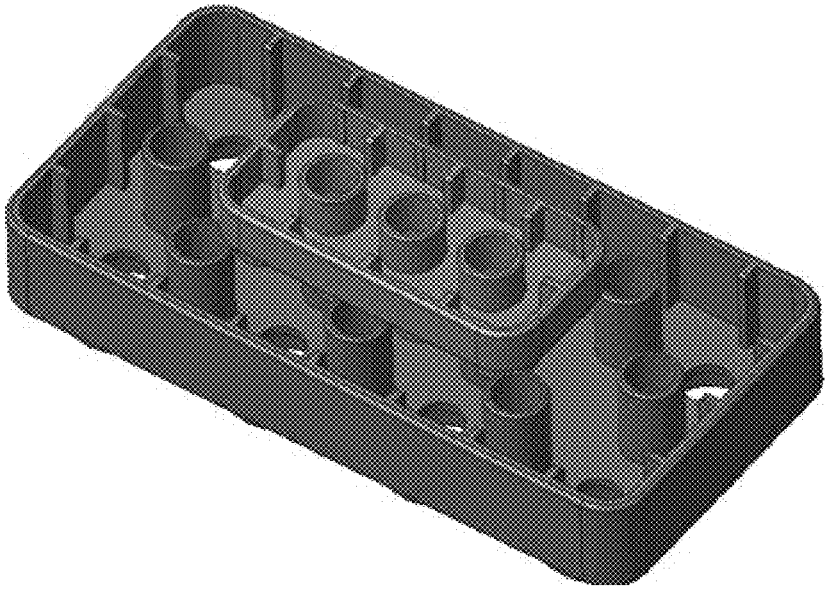
FIG. 13 is a schematic view showing the coupling of the back side of the C module and the front side of the D module after a random change of position.
Figure 14:
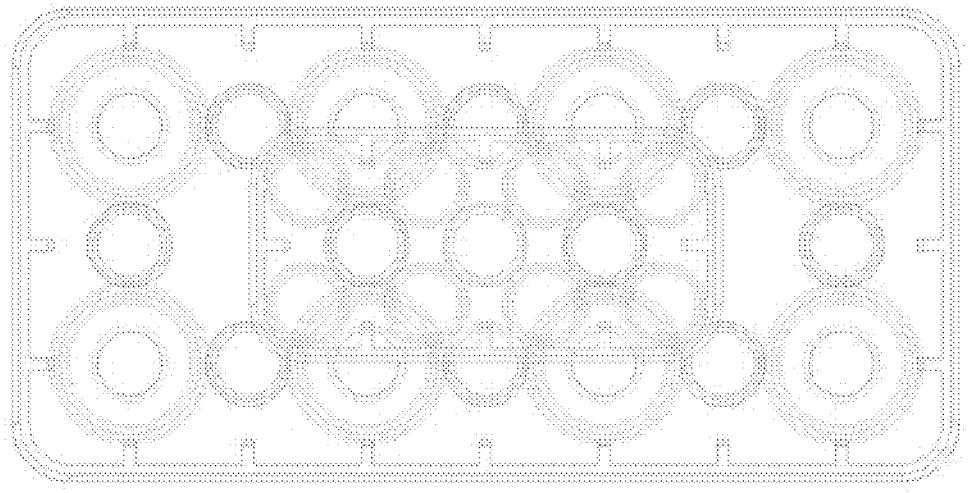
FIG. 14 is a principle diagram of the coupling relationship of FIG. 13.

FIG. 13 is a schematic view showing the coupling of the back side of the C module and the front side of the D module after a random change of position. FIG. 14 is a principle diagram of the coupling relationship of FIG. 13. No matter which position of the D module is coupled with which position of the C module, the coupling is free and successful because of the design of the coupling short posts r, s, t, u on the C module and the D module.

Figure 15:
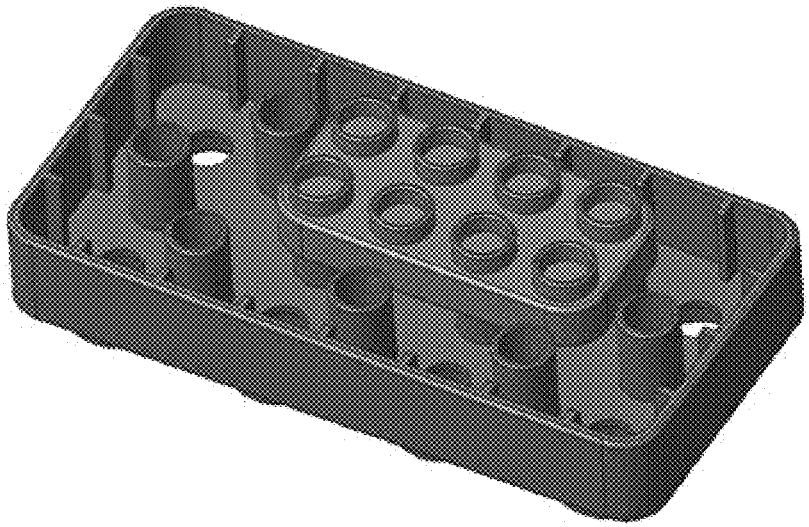
FIG. 15 is a schematic view showing the coupling of the back side of the C module and the back side of the D module according to the present invention.
Figure 16:
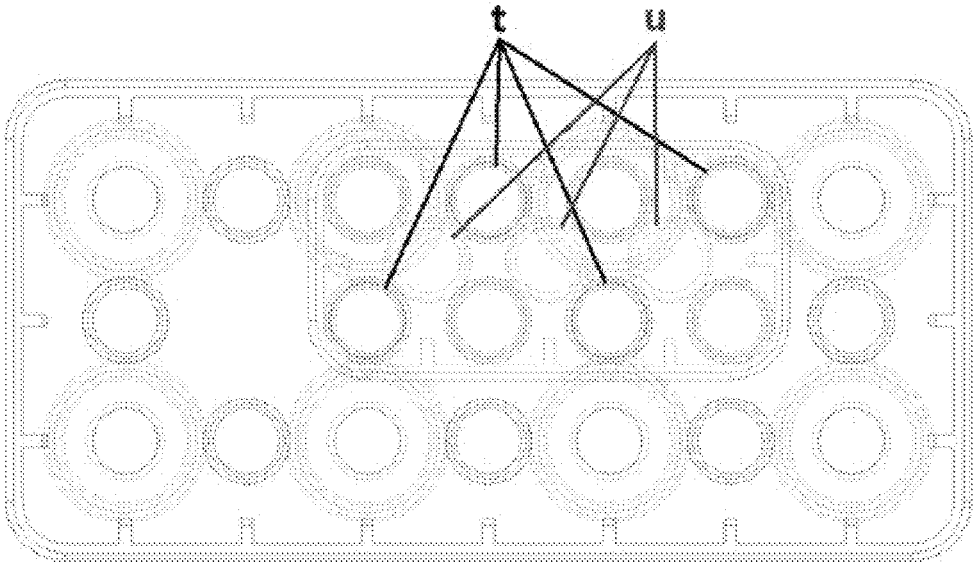
FIG. 16 is a principle diagram of the coupling relationship of FIG. 15.

FIG. 15 is a schematic view showing the coupling of the back side of the C module and the back side of the D module according to the present invention. FIG. 16 is a principle diagram of the coupling relationship of FIG. 15. The coupling is free and successful because of the design of the coupling short posts r, s, t, u on the C module and the D module.

Figure 17:
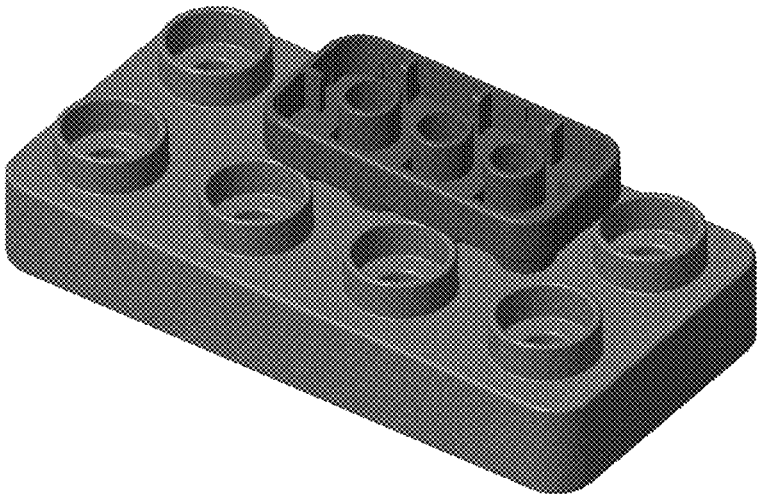
FIG. 17 is a schematic view showing the coupling of the front side of the C module and the front side of the D module according to the present invention.
Figure 18:
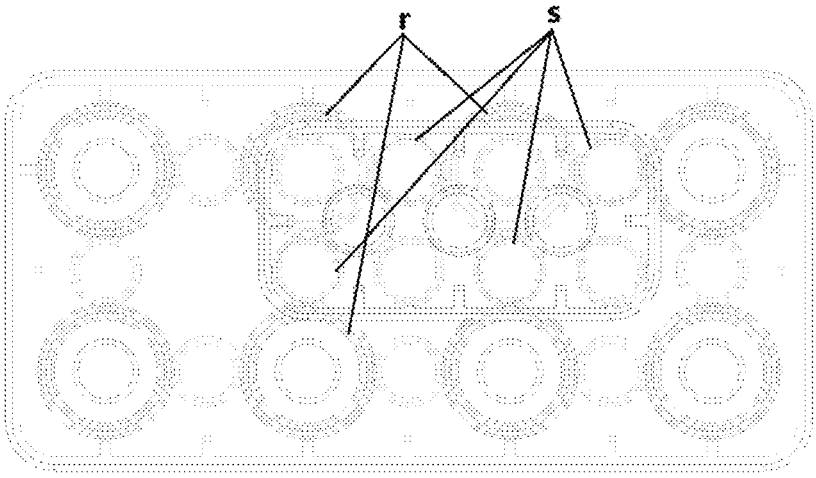
FIG. 18 is a principle diagram of the coupling relationship of FIG. 17.

FIG. 17 is a schematic view showing the coupling of the front side of the C module and the front side of the D module according to the present invention. FIG. 18 is a principle diagram of the coupling relationship of FIG. 17. The coupling is free and successful because of the design of the coupling short posts r, s, t, u on the C module and the D module.

Figure 19:
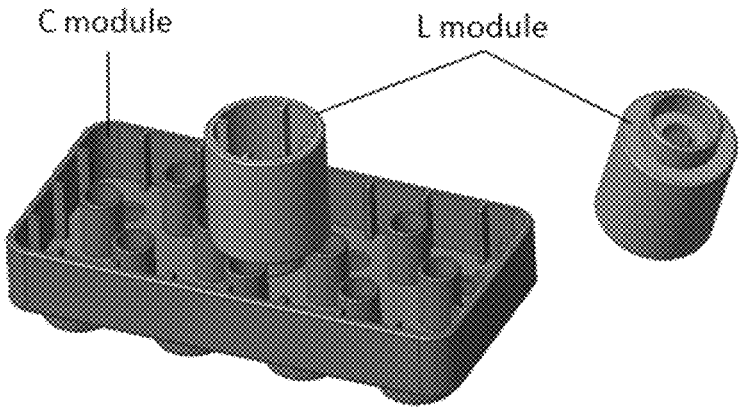
FIG. 19 is a schematic view showing the coupling of the C module and L module.

FIG. 19 is a schematic view showing the coupling of the C module and L module. The coupling is free and successful because of the design of the coupling short posts r, t on the front and back sides of the C module.

It can be seen from the above that, in addition to the building of the C module itself and the free building of conventional building blocks, the multi-dimensional building set of building block toys capable of being built freely on front and back sides of the present invention provides more free building capability and building feeling in the following various building ways:

1. Coupling of the front side of the C module and the back side of the D module: the frictional force is produced by the coupling of the coupling short post r, the coupling short post u and the sidewall of the D module. Since the deformation force of the sidewall is relatively small, this way can better control the frictional force of the coupling and the feeling of experience than the prior art.

2. Coupling of the back side of the C module and the front side of the D module: the frictional force is produced by both of the sidewall of the C module and the coupling short post t and the coupling short post s on the front side of the D module. The design of the present invention can achieve coupling anywhere.

3. Coupling of the back side of the C module and the back side of the D module: since the diameters of the coupling short posts s, t, and u of the present invention are the same, the back side of the C module and the back side of the D module can be arbitrarily coupled and built.

4. Coupling of the front side of the C module and the front side of the D module: the diameters of the coupling short posts s and u on the front and back sides of the D module are the same, therefore, in addition to the coupling of the back side of the D module and the front side of the C module, the front side of the D module and the front side of the C module can be arbitrarily coupled and built, especially when the C module is a very large flat element (such as 50 CM*50 CM), this feature will be more prominent. (FIG. 17, FIG. 18)

Figure 21:
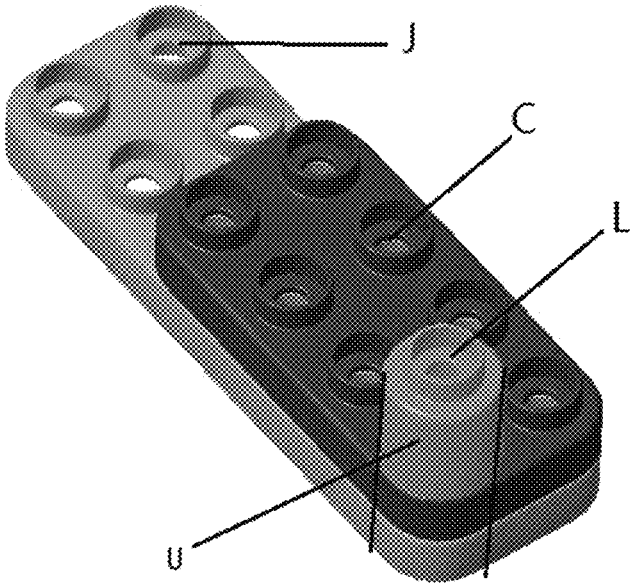
FIG. 21 shows a plurality of unit modules C, L, and J that are assembled to form a uniform fitting curved surface.

5. Coupling of the back side of the C module and the front side of the L module: the L module is an implementation of the C module and the front side thereof has only one coupling short post, and the diameter of the coupling short post is the same as r, therefore, the L module can be coupled to any position of the back side of the C module, which can provides a lot of variation and design space. (FIG. 19) Wherein the L module is an implementation of the C module and the front side thereof has only one coupling short post, and the concave surface on the back side of the L module does not have a second coupling short post (t), but has a plurality of ribs on the sidewall of the concave surface. For example, as shown in FIG. 19, the number of ribs may be four. Although the back side of the L module does not have a second coupling short post (t), the back side of the L module can be coupled to the front side of the other first module (e.g., module C) by the ribs of the concave surface on the back side of the L module, as shown in FIG. 21.

6. The coupling short post on the front side of the C/D module is not limited to eight. The illustration in this document is only schematic, and there can be 1, 2, 3 . . . 5 . . . 10 . . . 20 . . . 50 . . . and countless coupling short posts, which can provide more unimaginable building fun.

Figure 20:
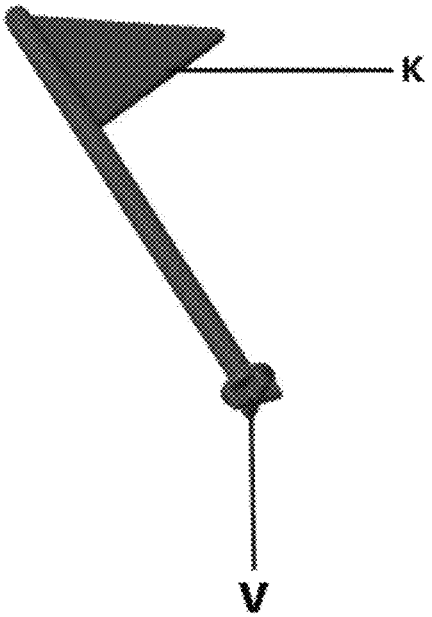
FIG. 20 is a schematic view of K module showing that the K module can be plugged into a through hole of the C module through a post head v.

In addition, the present invention also provides some special structural elements, free modules and stable building. FIG. 20 is a schematic view of K module showing that the K module can be plugged into a through hole of the C module through a post head v.

The post head v of the K module has an interference fit with the inner hole of the coupling short post r, for example, the diameter d(L) of the cross-shaped post head v is 10.8 mm, the diameter of the inserted post r is designed as d(E)=10.7 mm, and a frictional force is produced by the interference fit.

As shown in FIG. 21, the building block module of the present invention has the following subtle design to realize better hand feeling and safer building:

All module edges are rounded; the coupling short posts of the modules and the rounded corners of the edges have the same center; therefore, a plurality of unit modules C, J and L can be assembled to form a uniform fitting curved surface U to realize more comfortable hand feeling and more uniform appearance.

It can be seen from the above description that the invention realizes five ways of free building through the ingenious structural design of the building set of building block toys, that is, the front side of the C module and the back side of the D module, the back side of the C module and the front side of the D module, the back side of the C module and the back side of the D module, the front side of the C module and the front side of the D module, the back side of the C module and the front side of the L module, and the building of any element and module is more free, safe and has good hand feeling; it is easier to build toys of different series and different designs with uniform appearance and comfortable hand feeling, such that the ideas of the builder can be achieved and its economic value is incalculable.

The foregoing description of the exemplary embodiments of the present invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A multi-dimensional building set of building block toys capable of being built freely on front and back sides, comprising: a first module, wherein, a front side of the first module has a single first coupling short post or a single column, two columns or multiple columns of first coupling short posts (r), and a back side of the first module has a concave surface, there are multiple columns of convex second coupling short posts (t) in the concave surface and there are a plurality of ribs on sidewalls of the concave surface; the second coupling short posts (t) are distributed as follows:

column: the columns are uniformly distributed in the same columns as the first coupling short posts (r) on the front side and located in a middle position between two adjacent columns;

line: in the same columns as the first coupling short posts (r) on the front side, each of the second coupling short posts (t) is arranged alternately with the first coupling short post (r) and located in a middle position between two first coupling short posts (r); therefore, in such a column, the number of the second coupling short posts (t) is one less than the number of the first coupling short posts (r);

in a column located in a middle position between two adjacent columns of the first coupling short posts (r), each of the second coupling short posts (t) is located in the middle position between two first coupling short posts (r) of the same line; therefore, in such a column, the number of the second coupling short posts (t) is the same as the number of the first coupling short posts (r);

or:

the front side of the first module has a single first coupling short post (r), the back side of the first module has a concave surface, the sidewalls of the concave surface have a plurality of ribs, and the concave surface does not have a coupling short post.

2. The multi-dimensional building set of building block toys capable of being built freely on front and back sides according to claim 1, further comprises a second module, wherein a front side of the second module has a single first coupling short post or a single column, two columns or multiple columns of third coupling short posts (s), the third coupling short post (s) is a cylinder penetrating through the second module; the number of the third coupling short posts (s) may be 1, 2, 3 or any number.

3. The multi-dimensional building set of building block toys capable of being built freely on front and back sides according to claim 2, wherein a back side of the second module has a concave surface, there are convex fourth coupling short posts (u) in the concave surface and there are a plurality of ribs exactly facing the fourth coupling short posts (u) on the sidewalls of the concave surface; the fourth coupling short posts (u) on the back side of the second module are distributed as follows:

column: the columns are located in a middle position between two adjacent columns of the third coupling short posts (s) on the front side;

line: each of the fourth coupling short posts (u) is located in a middle position between two third coupling short posts (s); therefore, the number of the fourth coupling short posts (u) is one less than the number of the third coupling short posts (s).

4. The multi-dimensional building set of building block toys capable of being built freely on front and back sides according to claim 3, wherein the diameters of the second coupling short post (s), the third coupling short post (t) and the fourth coupling short post (u) are the same; the relationship of the diameters of the second coupling short post (s), the third coupling short post (t) and the fourth coupling short post (u) and the width of the second modules is:

the diameter of the coupled post is $d(s)=X/2-g*2-h*2$, wherein, X is the width of the second module; g is the wall thickness of the sidewall of the second module; and h is the thickness of the rib on the sidewall of the second module.

5. The multi-dimensional building set of building block toys capable of being built freely on front and back sides according to claim 4, wherein the width of the second module is 20 mm, the wall thickness g of the sidewall of the second module is 1.2 mm, the thickness h of the rib on the sidewall of the second module is 0.25 mm; the diameters of the second coupling short post (s), the third coupling short post (t) and the fourth coupling short post (u) are $d(s)=d(t)=d(u)=7.1$ mm.

6. The multi-dimensional building set of building block toys capable of being built freely on front and back sides according to claim 5, wherein the diameter d(r) of the first coupling short post (r) on the first module is equal to the distance f between two adjacent second coupling short posts (t) subtracting d(t); the first coupling short post (r) is a cylinder penetrating through the first module.

7. The multi-dimensional building set of building block toys capable of being built freely on front and back sides according to claim 6, wherein the diameter d(r) of the first coupling short post (r) is equal to the distance f between two adjacent second coupling short posts (t) subtracting $d(t)=20-7.1=12.9$ mm.

8. The multi-dimensional building set of building block toys capable of being built freely on front and back sides according to claim 7, wherein the diameters of the first coupling short post (r), the second coupling short post (s), the three coupling short post (t) and the fourth coupling short post (u) is 0.01 mm to 0.10 mm larger than the calculated value.

9. The multi-dimensional building set of building block toys capable of being built freely on front and back sides according to claim 8, further comprising an element, a post head of the element having an interference fit with the cylindrical coupling short post.

10. The multi-dimensional building set of building block toys capable of being built freely on front and back sides according to claim 9, wherein all module edges are rounded; the coupling short posts of the modules and the rounded corners of the edges have the same center; a plurality of unit modules are assembled to form a uniform fitting curved surface.

* * * * *